US012037868B2

(12) United States Patent
Fripp et al.

(10) Patent No.: US 12,037,868 B2
(45) Date of Patent: Jul. 16, 2024

(54) HEAT HARDENING POLYMER FOR EXPANDABLE DOWNHOLE SEALS

(71) Applicant: HALLIBURTON ENERGY SERVICES, INC., Houston, TX (US)

(72) Inventors: Michael Linley Fripp, Carrollton, TX (US); Chad William Glaesman, McKinney, TX (US); Charles Timothy Smith, Edgewood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 106 days.

(21) Appl. No.: 17/195,101

(22) Filed: Mar. 8, 2021

(65) Prior Publication Data

US 2022/0282590 A1 Sep. 8, 2022

(51) Int. Cl.
*E21B 33/127* (2006.01)

(52) U.S. Cl.
CPC ..... *E21B 33/127* (2013.01); *E21B 33/1277* (2013.01); *E21B 2200/08* (2020.05)

(58) Field of Classification Search
CPC . E21B 33/127; E21B 2200/08; E21B 33/1277
See application file for complete search history.

(56) References Cited

U.S. PATENT DOCUMENTS 3,046,601 A * 7/1962 Hubbert ..... E21B 33/127 600/587
4,813,495 A * 3/1989 Leach ..... E21B 21/08 175/6
5,695,008 A 12/1997 Bertet et al.
5,964,288 A 10/1999 Leighton et al.
6,102,120 A * 8/2000 Chen ..... E21B 29/10 166/57
6,938,698 B2 * 9/2005 Coronado ..... E21B 33/127 166/387
7,552,767 B2 6/2009 Wood
7,631,697 B2 12/2009 Bhavsar
8,091,855 B1 1/2012 Huang
(Continued)

FOREIGN PATENT DOCUMENTS

EP 2592129 A1 5/2013
EP 2716700 4/2014
(Continued)

OTHER PUBLICATIONS

Smithson, Tony, The Defining Series: HPHT Wells, Mar. 10, 2016, Oilfield Review, retrieved from slb.com/resource-library/oilfield-review/defining-series/defining-hpht (Year: 2016).*
(Continued)

*Primary Examiner* — Robert E Fuller
(74) *Attorney, Agent, or Firm* — DeLizio, Peacock, Lewin & Guerra, LLP

(57) ABSTRACT

An expandable, hardening seal for downhole use in a wellbore includes a heat-hardening material and a heat-stable material. The heat-hardening material has a stiffness that increases after exposure to a downhole temperature and the heat-stable material has a stiffness that does not increase or increases to a lesser degree than that the heat-hardening material at the downhole temperature.

22 Claims, 6 Drawing Sheets

(56) References Cited

U.S. PATENT DOCUMENTS

| | | | | |
|---|---|---|---|---|
| 10,767,439 | B1 | 9/2020 | Rosenholm | |
| 2004/0256114 | A1 | 12/2004 | Coronado | |
| 2008/0121436 | A1 | 5/2008 | Slay et al. | |
| 2011/0036597 | A1* | 2/2011 | Corre | E21B 33/1277 166/138 |
| 2011/0086942 | A1 | 4/2011 | Robisson et al. | |
| 2011/0121516 | A1 | 5/2011 | Hallundbaek | |
| 2011/0124787 | A1* | 5/2011 | Satou | C08L 7/00 525/185 |
| 2013/0277496 | A1* | 10/2013 | Kraus | B64B 1/08 244/125 |
| 2014/0374099 | A1* | 12/2014 | Wagle | E21B 43/12 166/295 |
| 2016/0312567 | A1 | 10/2016 | Murphree et al. | |
| 2018/0265682 | A1 | 9/2018 | Roy et al. | |
| 2018/0328139 | A1* | 11/2018 | Mhaskar | E21B 34/063 |
| 2019/0055807 | A1 | 2/2019 | Sadana et al. | |

FOREIGN PATENT DOCUMENTS

| | | | | |
|---|---|---|---|---|
| EP | 2918608 | A1 * | 9/2015 | C08C 19/02 |
| WO | WO 2013/126190 | A1 | 8/2013 | |
| WO | WO 2013/158487 | A1 | 10/2013 | |
| WO | 2019183160 | | 9/2019 | |
| WO | 2020204940 | | 10/2020 | |

OTHER PUBLICATIONS

Search Report and Written Opinion issued for International Patent Application No. PCT/US2021/021469, dated Nov. 22, 2021, 12 pages.

"DK Application No. PA 20230 30044 Office Action", Apr. 9, 2024, 10 pages.

* cited by examiner

HEAT HARDENING POLYMER FOR EXPANDABLE DOWNHOLE SEALS

TECHNICAL FIELD

The present disclosure relates generally to downhole seals in operations related to subterranean wellbores, e.g., wellbores employed for oil and gas exploration, drilling and production. More particularly, embodiments of the disclosure relate to an expandable downhole seal including a heat-hardening material.

BACKGROUND

The oilfield needs seals to block water production and to seal junctions. However, traditional metal seals are difficult to install. As such, there remains a need for a material that is flexible and stretchable during installation and then stiffens after the installation is completed.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements. Embodiments are described in detail hereinafter with reference to the accompanying figures, in which.

DETAILED DESCRIPTION OF THE DISCLOSURE

Figure 1:
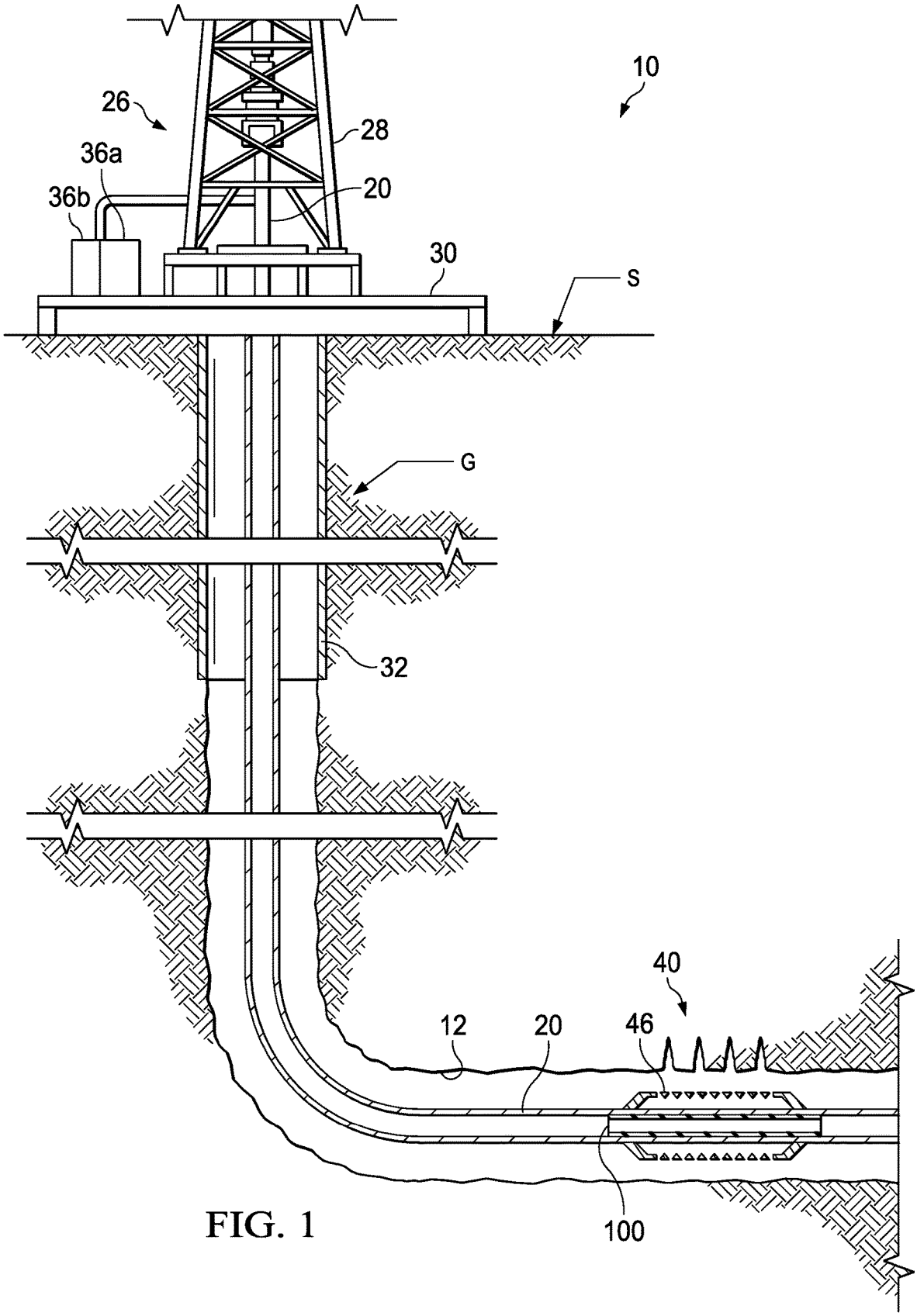
FIG. 1 is a simplified cutaway view of an environment in which an expandable seal according to an embodiment of the present disclosure may be employed.

The following disclosure provides many different embodiments or examples. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Referring to FIG. 1, the production system 10 may be employed for recovering hydrocarbons from a geologic formation "G" through a wellbore 12. Expandable seal 100 may also have application in wellbore servicing systems, drilling systems, wellbore storage and injection operations and the like. Although the illustrated wellbore 12 extends from a terrestrial surface location "S" disposed over the geologic formation "G," objects of the disclosure may also be practiced in connection with subsea applications wherein the surface location is a seafloor.

In the embodiment shown in FIG. 1, a drilling or servicing rig 26 is disposed at the surface location "S" and comprises a derrick 28 with a rig floor 30 through which the tubing string 20 passes. The drilling or servicing rig 26 may be conventional and may comprise a motor driven winch and other associated equipment for raising and lowering the tubing string 20 within the wellbore 12. In some embodiments, the tubing string 20 may comprise two or more concentrically positioned strings of pipe or tubing (e.g., a first work string may be positioned within a second work string). Moreover, the tubing string may alternatively include coiled tubing, drill string, a tool string, a segmented tubing string, a jointed tubing string, or any other suitable conveyance, or combinations thereof, that may be manipulated with a mobile workover rig, a wellbore servicing unit or another suitable apparatus for lowering and/or lowering the tubing string 20 within the wellbore 12. Thus, it is contemplated that the tubing string 20 may be utilized in drilling, stimulating, completing, or otherwise servicing the wellbore, or combinations thereof.

The tubing string 20 may include a screen or perforated portion 46 through which fluids from fluid production zone 40 are able enter the tubing string 20. As shown in FIG. 1, the expandable seal 100 is in its expanded configuration proximate the screen 46, thereby sealing the tubing string 20 from the fluid production zone 40.

The production system 10 may further include at least one source 36*a*, 36*b* of fluid for expanding the expandable seal 100. The fluid may be stored at the surface location "S" and pumped into the wellbore 12 at an appropriate time for expanding the expandable seal 100. In other embodiments, the expandable seal 100 may be expanded by wellbore fluids, e.g., hydrocarbon-based fluids or drilling fluids, already present in the wellbore 12. In some embodiments, the fluid in source 36*a*, 36*b* may be a water-based fluid (e.g., aqueous solutions, water, etc.), an oil-based fluid (e.g., hydrocarbon fluid, oil fluid, oleaginous fluid, terpene fluid, diesel, gasoline, xylene, octane, hexane, etc.), or combinations thereof.

Figure 2:
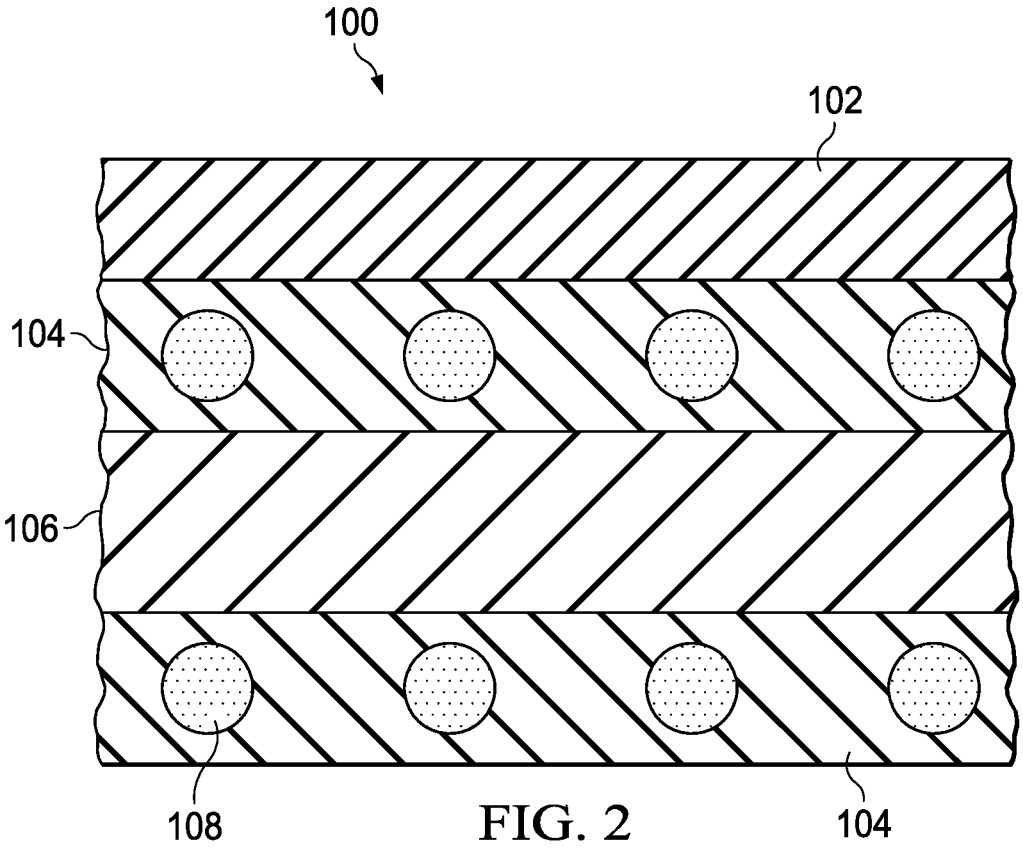
FIG. 2 is a cross-sectional schematic diagram of an expandable seal according to an embodiment of the present disclosure.
Figure 3:
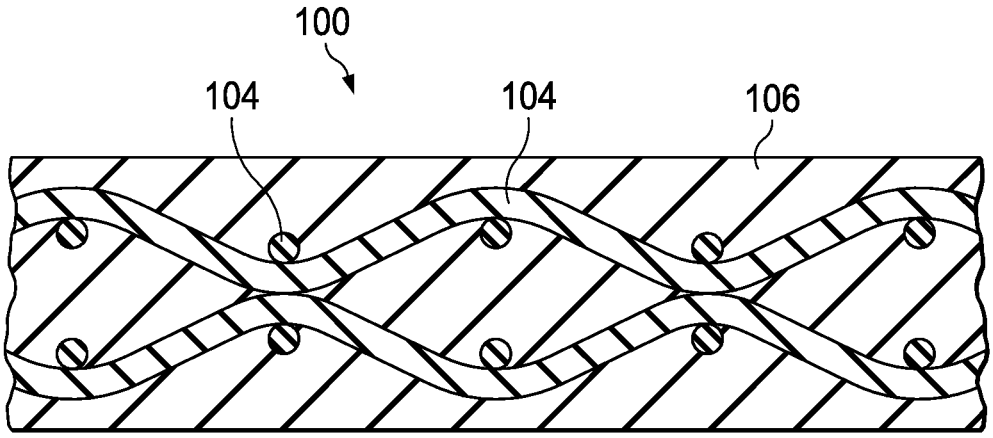
FIG. 3 is a cross-sectional schematic diagram of an expandable seal according to an embodiment of the present disclosure.

Turning to FIG. 2, the expandable seal 100 includes a heat-stable material 106 and a heat-hardening material 104, and optionally may include a swellable material 102 and/or a reinforcing material 108. A shown in FIG. 2, the heat-stable material 106, heat-hardening material 104, and swellable material 102 may be layered, with one or more layers of each material in the expandable seal 100. In some embodiments, the swellable material 102 is positioned on an outer surface of the expandable seal 100 to improve the sealing properties of the expandable seal 100. The reinforcing material 108 may be incorporated into any of the foregoing layers, e.g., in one or more layers of the heat-hardening material 104. In some embodiments, the reinforcing material 108 is dispersed throughout the entire expandable seal 100. In some embodiments, the reinforcing material 108 forms a separate layer of the expandable seal 100. In an alternate configuration shown in FIG. 3, the expandable seal 100 may comprise one or more layers of heat-hardening material 104 mesh impregnated or blended with the heat-stable material 106. In one or more embodiments, the heat-hardening material 104 is in the form of fibers, weaves, mesh, and/or particles and serves as a reinforcement within heat-stable material 106, which acts as a binder. In other embodiments, the expandable seal 100 comprises a porous sheet of the heat-stable material 106, where the pores of the sheet are filled with a heat-hardening material 104. In some embodiments, the pores in the sheet may have a honeycomb shape or form a slot or a curved line.

By including the heat-stable material 106 and the heat-hardening material 104, the expandable seal 100 is a hardening composite wherein the heat-stable material 106 is used to toughen the composite and to provide sealing in the event that the heat-hardening material 104 stiffens to the point of creating cracks. In other words, the heat-hardening material 104 may become brittle as it hardens and the heat-stable material 106 provides load transfer to maintain the integrity of the expandable seal 100. The result is an expandable seal 100 that is stretchy during installation but will harden after aging at temperature. In some embodiments, the expandable seal 100 may be able to strain greater than 10%, 50%, or 100% before heat aging. The expandable seal 100 according to the present disclosure may be used, e.g., to create a seal for screen shutoff, open hole isolation, zero-extrusion packers, and multilateral junctions.

The heat-stable material 106 may include polymers (elastomers and plastics) and/or metals. In one or more embodiments, the heat-stable material 106 may include one or more of peroxide-cured hydrogenated acrylonitrile butadiene rubber (HNBR), fluoroelastomers or fluorocarbons (FKM), polytetrafluoroethylene (PTFE), urethane, silicone, fluorosilicone, perfluoroelastomer (FFKM), ethylene acrylic, ester acrylic, tetrafluoroethylene and propylene copolymer (FEPM), polyether ether ketone (PEEK), polyphenylene sulfide (PPS), polysulfone (PSU), polyethersulfone (PES), polyetherimide (PEI), and polyetherketone (PEK). In some embodiments, the heat-stable material 106 comprises a metal or porous metal, such as stainless steel.

The heat-hardening material 104 comprises a thermoset elastomer and may include one or more of HNBR, acrylonitrile butadiene rubber (NBR), chloroprene rubber (CR), polybutadiene rubber (BR), poly(styrene-butadiene-styrene) (SBS), styrene-butadiene rubber (SBR), ethylene propylene rubber (EPM), ethylene propylene diene monomer rubber (EPDM), butyl rubber, and polyethylenes such as chlorinated polyethylene (CPE) or chlorosulfonated polyethylene (CSM). The heat-hardening material 104 may be cured with a sulfur cure or may be capable of hardening with non-sulfur cures. For instance, hardening occurs in many diene rubbers with less active double bonds due to electron-withdrawing groups such as a halogen (as is the case with CR).

In one or more embodiments, the heat-hardening material 104 is hardened via cross-linking upon exposure to heat, wherein this process drastically reduces the flexibility of the heat-hardening material 104. The heat-hardening material 104 can be tailored based on the wellbore conditions, including temperature profiles and downhole fluid composition. In some embodiments, the heat-hardening material 104 hardens after being exposed to a temperature of 250° F. or greater, 275° F. or greater, 300° F. or greater, 325° F. or greater, 350° F. or greater, 375° F. or greater, 400° F. or greater, 425° F. or greater, 450° F. or greater, 475° F. or greater, or 500° F. or greater for a period of 1 hour, 4 hours, 8 hours, 12 hours, 16 hours, 20 hours, 24 hours, 48 hours, or 72 hours.

In one or more embodiments, the heat-hardening material is a sulfur-cured HNBR rubber. This material is not heat stable and with time at temperature, this rubber will become hard and stiff. A composite structure (expandable seal 100) that is partially composed from the not-heat-stable elastomer is flexible during installation but stiffens when exposed to heat.

In some embodiments, the expandable seal 100 includes residual cross-linkers and accelerators, e.g., incorporated into the heat-hardening material 104. This accelerates the cross-linking and the hardening of the heat-hardening material 104. In some embodiments, these additives themselves undergo thermal decomposition at elevated temperature, producing radicals that are capable of accelerating the hardening of the heat-hardening material 104. For example, soluble fatty acid salts of metal ions such as Cu, Mn, Ni, Co, and Fe act as catalysts for oxidation, and thus greatly accelerate the hardening of the heat-hardening material 104.

Some materials can be considered heat-stable and heat-hardening depending on the operating temperature. For example, FKM would be considered a heat-stable polymer below 400° F. and a heat-hardening polymer above 400° F. As another example, many classes of urethane will degrade above 220° F. but are stable at lower temperatures. As used herein, the heat-hardening material 104 is a material that will harden under the expected use conditions of the expandable seal and the heat-stable material 106 is a material that will not harden under those same conditions.

In some embodiments, the heat-hardening material 104 is a material that has a stiffness that at least doubles after exposure to a given temperature and the heat-stable material 106 is a material that has a stiffness that does not increase by 2× or more after exposure to said temperature. In some embodiments, the heat-hardening material 104 is a material that has a stiffness that increases by at least 3× after exposure to a given temperature and the heat-stable material 106 is a material that has a stiffness that does not increase by 3× or more after exposure to said temperature. In some embodiments, the heat-hardening material 104 is a material that has a stiffness that increases by at least 5× after exposure to a given temperature and the heat-stable material 106 is a material that has a stiffness that does not increase by 5× or more after exposure to said temperature. In some embodiments, the heat-hardening material 104 is a material that has a stiffness that increases by at least 10× after exposure to a given temperature and the heat-stable material 106 is a material that has a stiffness that does not increase by 10× or more after exposure to said temperature. The above are all examples wherein the heat-hardening material 104 has a stiffness that increases after exposure to a downhole temperature and the heat-stable material 106 has a stiffness that does not increase or increases to a lesser degree than that the heat-hardening material at the downhole temperature. In some embodiments, the heat-hardening material 104 has a stiffness that increases after exposure to a downhole temperature by a factor of x, wherein x is at least 1.5, at least 2, or at least 3, and the heat-stable material 106 has a stiffness that does not increase by a factor of x or more after exposure to the downhole temperature.

In some embodiments, the heat-hardening material 104 is a material that has an elastic recoil that reduces by at least 50% after exposure to a given temperature and the heat-stable material 106 is a material that has an elastic recoil reduces by less than 50% after exposure to said temperature.

In some embodiments, the heat-hardening material 104 is a material that has an elastic recoil that reduces by at least 75% after exposure to a given temperature and the heat-stable material 106 is a material that has an elastic recoil reduces by less than 75% after exposure to said temperature. In some embodiments, the heat-hardening material 104 is a material that has an elastic recoil that reduces by at least 90% after exposure to a given temperature and the heat-stable material 106 is a material that has an elastic recoil reduces by less than 90% after exposure to said temperature.

In some embodiments, the heat-hardening material 104 is a material that has a compression set of greater than 50% after exposure to a given temperature and the heat-stable material 106 is a material that has a compression set of less than 50%, less than 40%, or less than 30% after exposure to said temperature. In some embodiments, the heat-hardening material 104 is a material that has a compression set of greater than 60% after exposure to a given temperature and the heat-stable material 106 is a material that has a compression set of less than 50%, less than 40%, or less than 30% after exposure to said temperature. In some embodiments, the heat-hardening material 104 is a material that has a compression set of greater than 70% after exposure to a given temperature and the heat-stable material 106 is a material that has a compression set of less than 50%, less than 40%, or less than 30% after exposure to said temperature. In some embodiments, the heat-hardening material 104 is a material that has a compression set of greater than 80% after exposure to a given temperature and the heat-stable material 106 is a material that has a compression set of less than 50%, less than 40%, or less than 30% after exposure to said temperature. In some embodiments, the heat-hardening material 104 is a material that has a compression set of greater than 90% after exposure to a given temperature and the heat-stable material 106 is a material that has a compression set of less than 50%, less than 40%, or less than 30% after exposure to said temperature. In some embodiments, the heat-hardening material 104 is a material that has a compression set of about 100% after exposure to a given temperature and the heat-stable material 106 is a material that has a compression set of less than 50%, less than 40%, or less than 30% after exposure to said temperature.

In some embodiments, the heat-hardening material 104 serves as a hardening matrix and includes a reinforcing material 108 dispersed therein. The reinforcing material 108 may include glass, carbon, and/or metal fibers. The fibers can be long or short, woven, knit, braided, continuous, chopped, or milled. In some embodiments, the fibers are cylindrical braid. The fibers can be round, slats, plates, or any other appropriate shape. In one or more embodiments, the fibers are a plate that has pre-formed cuts, such as an expanded metal or a plate cut with internal trusses.

Figure 4A:
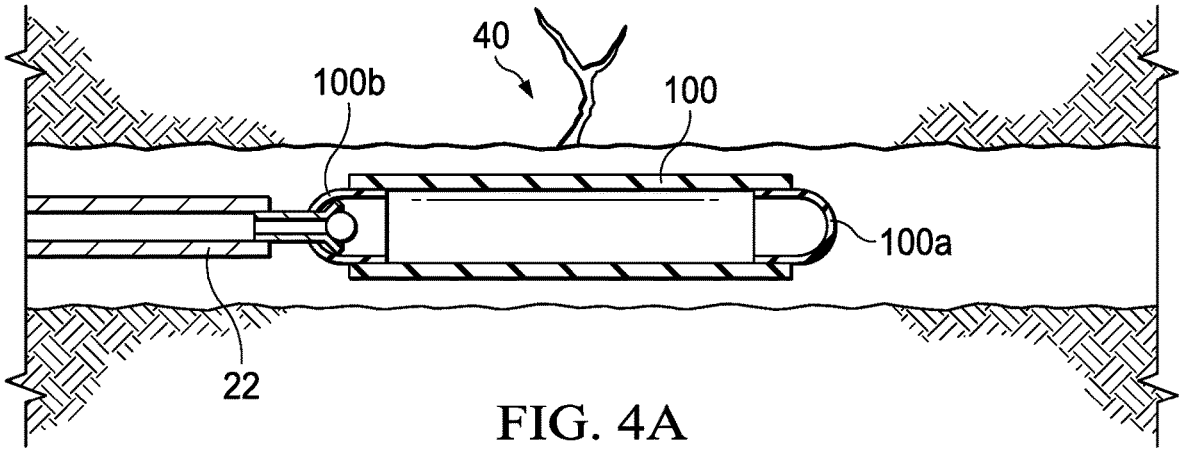
FIGS. 4*a*-4*c* are cross-sectional schematic diagrams showing a method of installing an expandable seal according to an embodiment of the present disclosure.
Figure 4B:
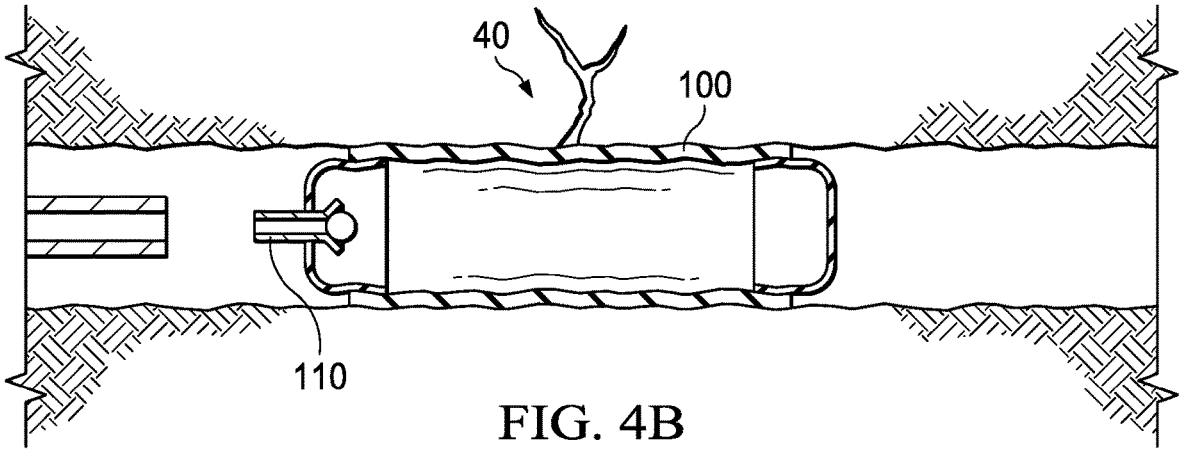
Figure 4C:
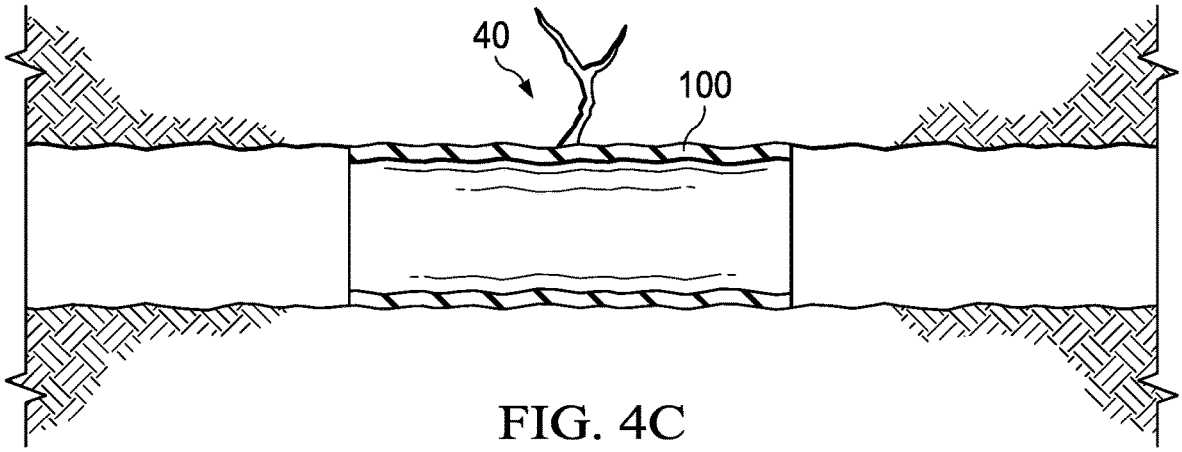

Turning to FIGS. 4*a*-4*c*, a method of sealing a fluid production zone 40 using the expandable seal 100 is shown. In FIG. 4*a*, a deployment step is shown wherein the expandable seal 100 is carried by a deployment tool 22, which may, e.g., be coiled tubing. In some embodiments, prior to being set, the expandable seal 100 includes a closed downhole end 100*a* and a closed uphole end 100*b*. In one or more embodiments, one or both of the uphole end 100*b* and downhole end 100*a* include a valve 110, such as a check valve. The deployment tool 22 carries the expandable seal 100 to a position proximate a fluid production zone 40. In some embodiments, the fluid production zone 40 is a screen or perforated pipe of the tubing string 20. In other embodiments, the fluid production zone 40 is in an open hole section of the wellbore 12 and may be a zone producing water or other fluids such as gas or oil. In some embodiments, the fluid production zone 40 is an annulus between the wellbore wall and the tubing string 20, such that the expandable seal 100 is useful at any portions of the tubing string 20 that may require reinforcement (e.g., at a junction).

Next, in FIG. 4*b*, a deforming step is shown wherein the expandable seal 100 is deformed to increase an outer diameter thereof. The deployment tool 22 may be withdrawn before or after the deforming step. In the embodiment shown, the check valve 110 allows fluids to enter a closed interior of the expandable seal 100 and the elastic nature thereof allows the expandable seal 100 to expand until an outer surface thereof comes into sealing contact (e.g., a fluid-tight seal) with the fluid production zone 40. In some embodiments, the deployment tool 22 may be connected to a fluid source and configured to pump fluid into the expandable seal 100 to inflate the expandable seal 100. In some embodiments, the expandable seal 100 may be inflated and deformed using a downhole pump in fluid communication with the expandable seal. In some embodiments, a gaseous reaction occurs inside the expandable seal 100 to inflate and deform the expandable seal 100. In some embodiments, the expandable seal 100 is mechanically deformed using, for example, blocks.

Next, in FIG. 4*c*, an opening step is shown wherein the ends 100*a*, 100*b* are removed to create an open passage through the expandable seal 100. In the embodiment shown, the ends 100*a*, 100*b* are formed of a dissolvable material and the opening step comprises dissolving the ends 100*a*, 100*b*. Generally, a "dissolvable" material, as used herein, refers to a material configured for passive degradation or dissolution upon exposure to downhole well conditions. The degradation can be from reaction to water, reaction to oil, and/or reaction to heat. The dissolvable material may contain polyurethane, polylactide (PLA) plastic, and/or polyglycolide (PGA) plastic. In some embodiments, the ends 100*a*, 100*b* may be constructed from a hardening plastic that continues hardening until it is so brittle that it cracks and degrades.

In some embodiments, the dissolution may be aided by a fluid, such as an acid, pumped into the well 12 from the surface S. In some embodiments, the opening step comprises puncturing the ends 100*a*, 100*b* using a tool or pressure to open a passage through the expandable seal 100.

In one or more embodiments, a heat generator may be coupled to the expandable seal 100. Heat, such as from an exothermal chemical reaction, helps to accelerate the stiffening of the expandable seal 100. In one or more embodiments, water from the wellbore may react with a metal or a metal oxide included with the expandable seal 100 thereby generating heat and gas, wherein the gas inflates the expandable seal 100 and the heat accelerates the hardening of the heat-hardening material 104 of the expandable seal 100.

Although not explicitly shown, the method further includes an exposing step wherein the expandable seal 100 is exposed to an elevated temperature that is present at the fluid production zone 40. Examples of temperatures and exposure times are discussed in detail above. The expandable seal 100 includes a heat-hardening material 104 that hardens at a temperature present at fluid production zone 40, and the hardening of the heat-hardening material 104 stiffens the expandable seal 100. In some embodiments, the exposing step begins during the deployment step. In one or more embodiments, the exposing step does not finish (i.e., the exposure time does not elapse) until at least after the deforming step as the stiffened expandable seal 100 may not be as readily deformed. In some embodiments, the exposing step is completed prior to the opening step such that the expandable seal 100 fully stiffens while in an inflated configuration.

Figure 5:
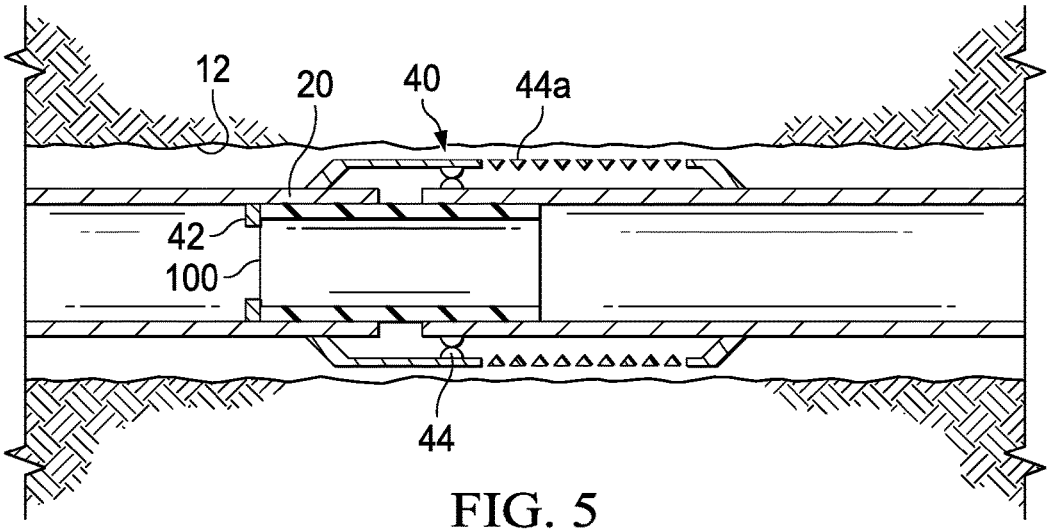
FIG. 5 is a cross-sectional diagram of an inflow control device sealed with expandable seal according to an embodiment of the present disclosure.

Turning to FIG. 5, the expandable seal 100 may be used to seal an inflow control device (ICD) 44 having a screen 44*a* open to a fluid production zone 40, such as an annulus between the wellbore wall and the tubing string 20. In some embodiments, one or more blocks 42 may be used to secure the expandable seal in place.

Figure 6:
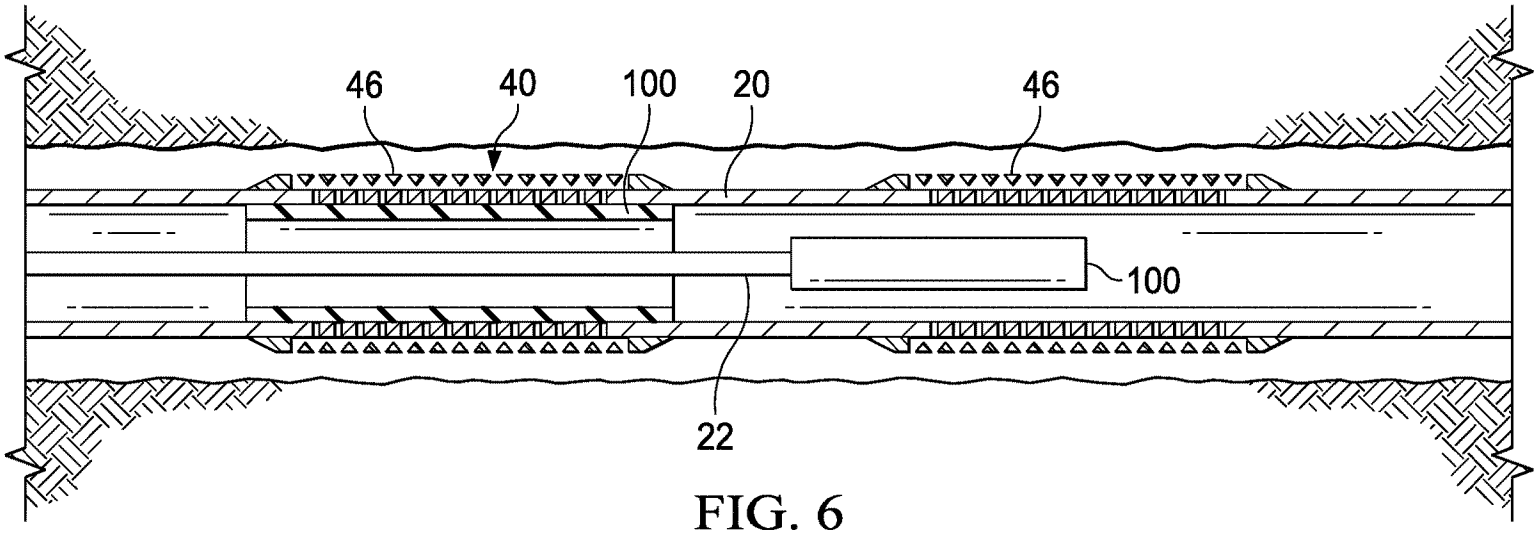
FIG. 6 is a cross-sectional diagram of a screen sealed with expandable seal according to an embodiment of the present disclosure.

Due to the deforming and opening steps discussed above, the expandable seal 100 provides a clear passageway for other downhole tools. For instance, as shown in FIG. 6, a previously-set expandable seal 100 is positioned over a screen 46 of the tubing string 20 to seal the screen 46. A second expandable seal 100 is able to be deployed on a deployment tool 22 past the first expandable seal 100 to a second screen 46.

Figure 7:
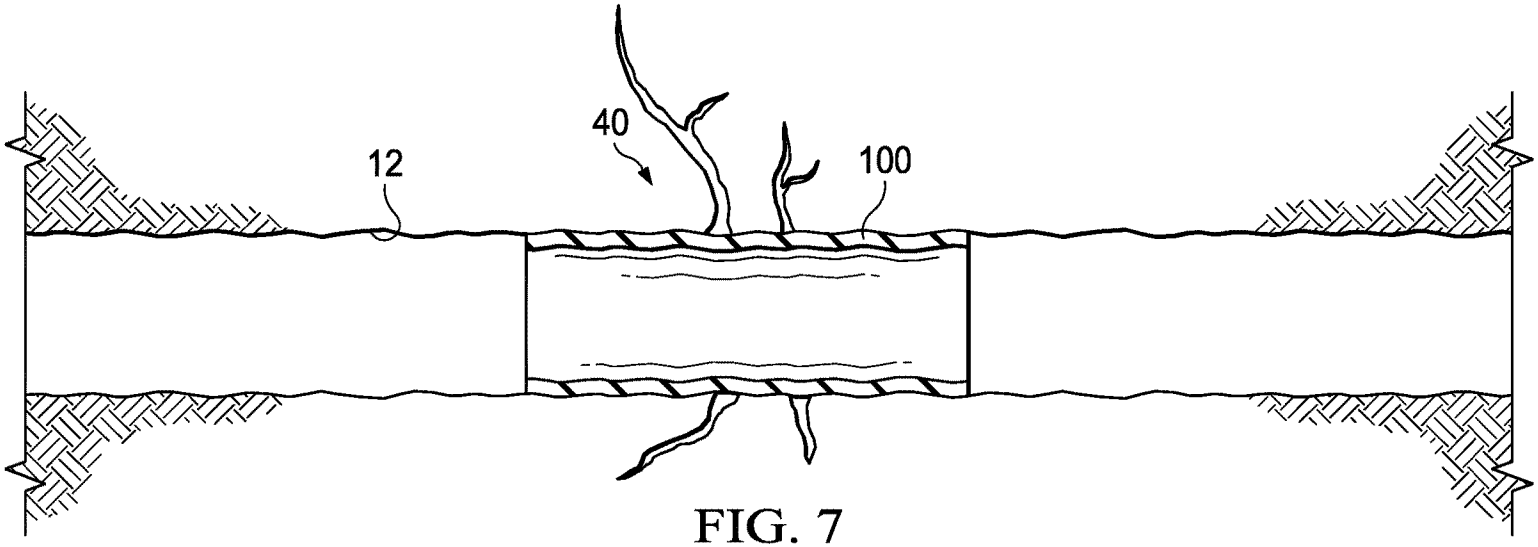
FIG. 7 is a cross-sectional diagram of an open hole section of a wellbore sealed with an expandable seal according to an embodiment of the present disclosure.

Prior to the exposing step, the expandable seal 100 is flexible and can be applied not only within the tubing string, but also in open-hole sections of the wellbore 12. For example, as shown in FIG. 7, the expandable seal 100 can be used to seal off a fluid production zone 40 in an uncased portion of the wellbore 12.

Figure 8:
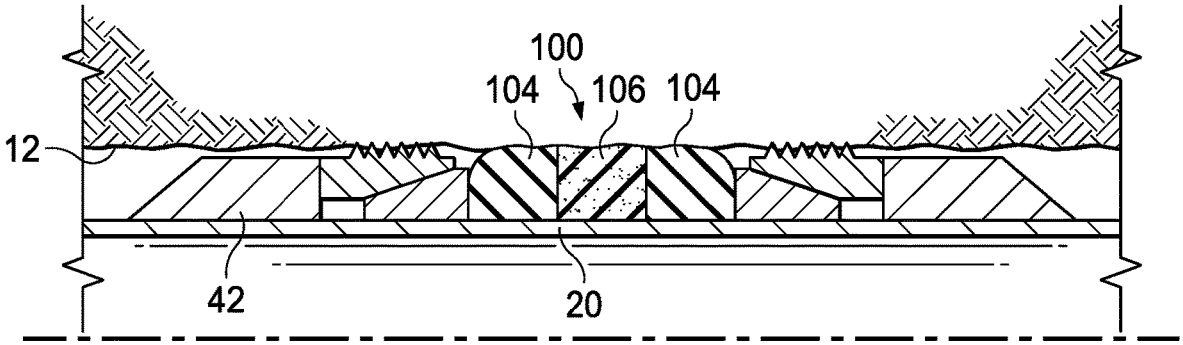
FIG. 8 is a cross-sectional diagram of a packer assembly employing an expandable seal according to an embodiment of the present disclosure.

The expandable seal 100 can also be used as a sealing element in a packer, as shown in FIG. 8. In one or more embodiments, the packer includes blocks 42 that may be used in the deformation step to compress the expandable seal 100 such that it radially expands against the wellbore 12. In some embodiments, the expandable seal 100 used in a packer may include uphole and downhole portions formed from the heat-hardening material 104 and a center portion made from the heat-stable material 106. According to this configuration, after the expandable seal 100 has been cured (i.e., after the exposing step), the heat-hardening material 104 locks the heat-stable material 106 in place.

Figure 9:
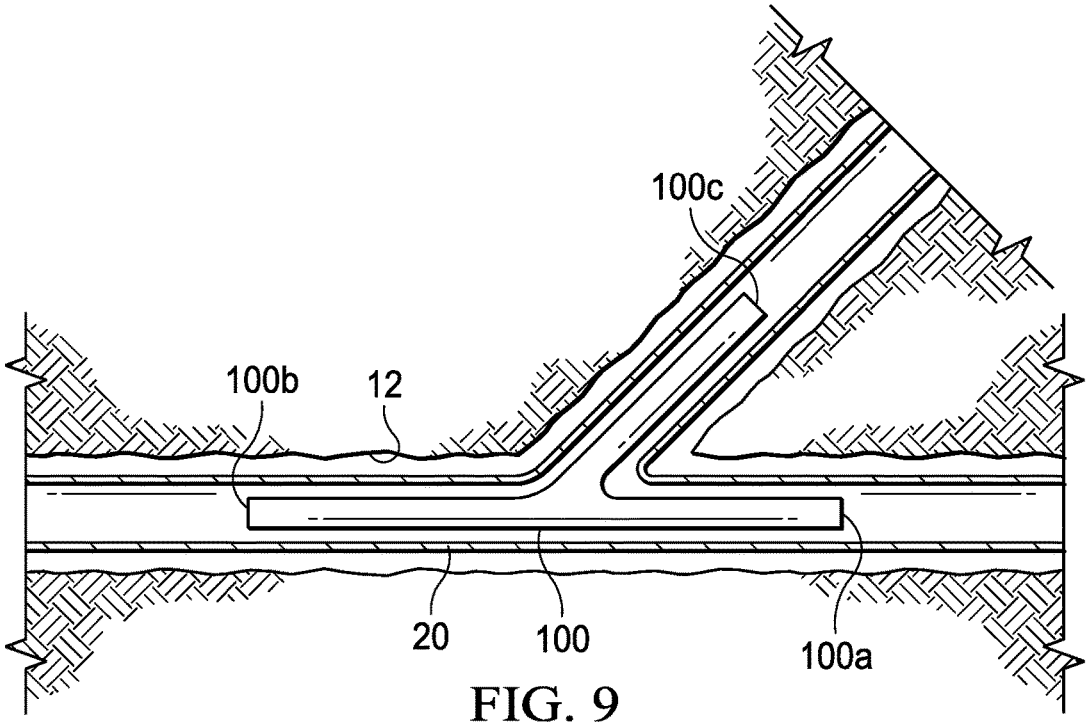
FIG. 9 is a cross-sectional diagram of a multilateral junction sealed with an expandable seal according to an embodiment of the present disclosure.

Turning to FIG. 9, in another embodiment, the expandable seal 100 may be deployed at a wellbore junction, such as a multi-lateral junction. In this embodiment, the expandable seal 100 is Y-shaped and includes three end portions, with a main downhole end 100*a*, a main uphole end 100*b*, and a lateral downhole end 100*c*. During deployment, each of the ends 100*a*, 100*b*, 100*c* may be closed as discussed above, and the installation of the expandable seal 100 may include opening each of the ends 100*a*, 100*b*, 100*c*.

A seal for downhole use in a wellbore has been disclosed herein. The seal includes a heat-hardening material and a heat-stable material, wherein the heat-hardening material has a stiffness that increases after exposure to a downhole temperature and the heat-stable material has a stiffness that does not increase or increases to a lesser degree than that the heat-hardening material at the downhole temperature. The seal may comprise one or more of the following features, and combinations thereof:

wherein the heat-hardening material comprises one or more of hydrogenated acrylonitrile butadiene rubber, acrylonitrile butadiene rubber, chloroprene rubber, polybutadiene rubber, poly(styrene-butadiene-styrene), styrene-butadiene rubber, ethylene propylene rubber, ethylene propylene diene monomer rubber, butyl rubber, chlorinated polyethylene, and chlorosulfonated polyethylene;

wherein the heat-stable material comprises one or more of hydrogenated acrylonitrile butadiene rubber, fluoroelastomers, acrylonitrile butadiene rubber, polytetrafluoroethylene, urethane, silicone, fluorosilicone, perfluoroelastomer, ethylene acrylic, ester acrylic, tetrafluoroethylene and propylene copolymer, polyether ether ketone, polyphenylene sulfide, polysulfone, polyethersulfone, polyetherimide, and polyetherketone;

wherein the heat-stable material comprises a porous metal, wherein pores of the metal are filled with the heat-hardening material;

further comprising a reinforcing material disperse within the heat-hardening material, the reinforcing material comprising glass, carbon, or metal fibers;

wherein the seal comprises one or more layers of the heat-hardening material, one or more layers of the heat-stable material, and one or more layers of a swellable material;

wherein the seal comprises a mesh of the heat-hardening material blended with the heat-stable material;

wherein the heat-hardening material is a sulfur-cured hydrogenated acrylonitrile butadiene rubber and the downhole temperature is 250° F. or greater;

wherein in a first configuration prior to exposure to the temperature, the seal is able to strain by at least 10%; and in a second configuration after exposure to the temperature for at least 4 hours, the seal is able to strain by less than 10%; and/or further comprising an oxidation catalyst selected that is a soluble fatty acid salt of Cu, Mn, Ni, Co, or Fe.

A method of sealing a production zone in a wellbore has been disclosed. The method includes providing an expandable seal comprising a heat-hardening material and a heat-stable material, wherein the heat-hardening material has a stiffness that increases after exposure to a downhole temperature and the heat-stable material has a stiffness that does not increase or increases to a lesser degree than that the heat-hardening material at the downhole temperature and wherein the expandable seal comprises a cylindrical body; deploying the expandable seal to the production zone; deforming the expandable seal such that a diameter of the expandable seal increases; exposing the expandable seal to the temperature, thereby hardening the heat-hardening material of the expandable seal. The method may comprise one or more of the following features, and combinations thereof:

wherein the expandable seal comprises closed ends and a check valve at one of the closed ends;

wherein deforming the expandable seal comprises inflating the expandable seal with a fluid;

further comprising dissolving the closed ends of the expandable seal;

wherein the downhole temperature is 250° F. or greater and the exposing step lasts for at least 4 hours;

wherein deploying the expandable seal comprises positioning the expandable seal proximate a screen of an inflow control device; and/or wherein the production zone comprises a water producing open hole zone.

A system for deploying a seal in a wellbore has been disclosed. The system includes an expandable seal and a deployment tool configured to carry the expandable seal to a downhole position, the downhole position having a temperature, wherein the expandable seal comprises a first material that has a stiffness that increases after exposure to the temperature and a second material that has a stiffness that does not increase or increases to a lesser degree than the first material at the temperature. The system may comprise one or more of the following features, and combinations thereof:

wherein the expandable seal forms an enclosed, elongate body; end portions of the expandable seal are formed of a dissolvable material; and the expandable seal comprises a valve at one of the end portions;

wherein the deployment tool comprises coiled tubing and the downhole position is proximate an inflow control device; and/or wherein the expandable seal is a Y-shaped liner for a multi-lateral junction.

Although various embodiments have been shown and described, the disclosure is not limited to such embodiments and will be understood to include all modifications and variations as would be apparent to one of ordinary skill in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

What is claimed is:

1. A seal for downhole use in a wellbore, comprising:

a heat-hardening material, wherein the heat-hardening material is a thermoset elastomer that includes one or more additives incorporated into the heat-hardening material to accelerate cross-linking when exposed to a downhole temperature in the wellbore; and a heat-stable material;

wherein the heat-hardening material has a stiffness that increases when exposed to the downhole temperature and the heat-stable material has a stiffness that does not increase or increases to a lesser degree than the heat-hardening material at the downhole temperature.

2. The seal of claim 1, wherein the heat-hardening material comprises one or more of hydrogenated acrylonitrile butadiene rubber, acrylonitrile butadiene rubber, chloroprene rubber, polybutadiene rubber, poly(styrene-butadiene-styrene), styrene-butadiene rubber, ethylene propylene rubber, ethylene propylene diene monomer rubber, butyl rubber, chlorinated polyethylene, and chlorosulfonated polyethylene.

3. The seal of claim 2, wherein the heat-stable material comprises a porous metal, wherein pores of the porous metal are filled with the heat-hardening material.

4. The seal of claim 1, wherein the heat-stable material comprises one or more of hydrogenated acrylonitrile butadiene rubber, fluoroelastomers, acrylonitrile butadiene rubber, polytetrafluoroethylene, urethane, silicone, fluorosilicone, perfluoroelastomer, ethylene acrylic, ester acrylic, tetrafluoroethylene and propylene copolymer, polyether ether ketone, polyphenylene sulfide, polysulfone, polyethersulfone, polyetherimide, and polyetherketone.

5. The seal of claim 1, further comprising a reinforcing material dispersed within the heat-hardening material, the reinforcing material comprising glass, carbon, or metal fibers.

6. The seal of claim 1, wherein the seal comprises one or more layers of the heat-hardening material, one or more layers of the heat-stable material, and one or more layers of a swellable material.

7. The seal of claim 1, wherein the seal comprises a mesh of the heat-hardening material blended with the heat-stable material.

8. The seal of claim 1, wherein the heat-hardening material is a sulfur-cured hydrogenated acrylonitrile butadiene rubber and the downhole temperature is 250° F. or greater.

9. The seal of claim 1, wherein in a first configuration prior to exposure to the downhole temperature, the seal is able to strain by at least 10%; and in a second configuration after exposure to the downhole temperature, the seal is able to strain by less than 10%.

10. The seal of claim 1, wherein the one or more additives is a soluble fatty acid salt of metal ions including Cu, Mn, Ni, Co, or Fe.

11. A method of sealing a production zone, comprising:

providing an expandable seal comprising a heat-hardening material and a heat-stable material, wherein the heat-hardening material is a thermoset elastomer that includes one or more additives incorporated into the heat-hardening material to accelerate cross-linking when exposed to a downhole temperature in a wellbore and has a stiffness that increases when exposed to the downhole temperature and the heat-stable material has a stiffness that does not increase or increases to a lesser degree than the heat-hardening material at the downhole temperature and wherein the expandable seal comprises a cylindrical body;

deploying the expandable seal to the production zone;

deforming the expandable seal such that a diameter of the expandable seal increases;

exposing the expandable seal to the downhole temperature, thereby hardening the heat-hardening material of the expandable seal.

12. The method of claim 11, wherein the expandable seal comprises closed ends and a check valve at one of the closed ends; and wherein deforming the expandable seal comprises inflating the expandable seal with a fluid.

13. The method of claim 12, further comprising:

dissolving the closed ends of the expandable seal.

14. The method of claim 11, wherein the downhole temperature is 250° F. or greater and the exposing step lasts for at least 4 hours.

15. The method of claim 14, wherein deploying the expandable seal comprises positioning the expandable seal proximate a screen of an inflow control device.

16. The method of claim 11, wherein the production zone comprises a water producing open hole zone.

17. A system for deploying a seal in a wellbore, comprising:

an expandable seal; and a deployment tool configured to carry the expandable seal to a downhole position, the downhole position having a temperature;

wherein the expandable seal comprises a first material that is a thermoset elastomer that includes one or more additives incorporated into the first material to accelerate cross-linking when exposed to the temperature in the wellbore and has a stiffness that increases when exposed to the temperature and a second material that has a stiffness that does not increase or increases to a lesser degree than the first material at the temperature.

18. The system of claim 17, wherein the expandable seal forms an enclosed, elongate body;

end portions of the expandable seal are formed of a degradable material; and the expandable seal comprises a valve at one of the end portions.

19. The system of claim 17, wherein the deployment tool comprises coiled tubing and the downhole position is proximate an inflow control device.

20. The system of claim 17, wherein the expandable seal is a Y-shaped liner for a multi-lateral junction.

21. The seal of claim 1, wherein the thermoset elastomer is hardened via cross-linking upon exposure to heat.

22. The system of claim 17, wherein the expandable seal is a sealing element in a packer.

* * * * *